US005632858A

United States Patent [19]

Kitto, Jr.

[11] Patent Number: 5,632,858

[45] Date of Patent: *May 27, 1997

[54] METHOD FOR GASIFYING CELLULOSIC WASTE LIQUOR USING AN INJECTOR LOCATED WITHIN THE BED OF FLUIDIZED MATERIAL

[75] Inventor: John B. Kitto, Jr., North Canton, Ohio

[73] Assignee: The Babcock & Wilcox Company, New Orleans, La.

[*] Notice: The term of this patent shall not extend beyond the expiration date of Pat. No. 5,543,117.

[21] Appl. No.: 419,874

[22] Filed: Apr. 11, 1995

Related U.S. Application Data

[62] Division of Ser. No. 202,330, Feb. 28, 1994, Pat. No. 5,455,011.

[51] Int. Cl.[6] ..... D21C 11/12

[52] U.S. Cl. ..... 162/30.1; 162/31; 48/203; 48/209; 422/146

[58] Field of Search ..... 162/29, 30.1, 31; 48/197 R, 105, 203, 209; 422/146, 182, 183, 185

[56] References Cited

U.S. PATENT DOCUMENTS 5,059,404 10/1991 Mansour et al. ..... 423/201

5,145,491 9/1992 Schmitt et al. ..... 48/197 R 5,543,117 8/1996 Kitto, Jr. ..... 422/145

OTHER PUBLICATIONS

Kinstrey, Robert B. "Tomlinson Recovery Furnace Alternatives," Rust International Corp. OPTEC, pp. 1–8.

Alzeta Corp. Burner Product Information.

U.S. application No. 08/152,757, filed Nov. 12, 1993.

*Primary Examiner*—Donald E. Czaja
*Assistant Examiner*—Dean T. Nguyen
*Attorney, Agent, or Firm*—Daniel S. Kalka; Robert J. Edwards

[57] ABSTRACT

A system for providing heated fluidized bed gasification of a residual waste liquor provides a bed of granular material and a source of liquor provided to the material bed. An injector is situated in the material bed and communicates with an air source, a fuel source and a steam source. Fuel and air are combusted in the injector and mixed with the steam which forms a combustion product and steam mixture which is in turn injected into the material bed. The combustion and mixing is separated from the bed material by being confined within the injector. The injector is a bubble cap having at least one hole or an injector made of a porous ceramic material.

6 Claims, 2 Drawing Sheets

METHOD FOR GASIFYING CELLULOSIC WASTE LIQUOR USING AN INJECTOR LOCATED WITHIN THE BED OF FLUIDIZED MATERIAL

This is a divisional of U.S. patent application Ser. No. 08/202/330 filed Feb. 28, 1994 now U.S. Pat. No. 5,455,011, issued Oct. 3, 1995.

BACKGROUND OF THE INVENTION

1. Field of the Invention

The present invention relates in general to heating fluidized bed gasification systems, and in particular to a new and useful system and method for gasifying residual waste liquor.

2. Description of the Related Art

In certain processes, for instance, the Kraft paper making process, a residual waste liquor such as black liquor byproduct produced in this process is gasified using a fluidized bed. The fluidized bed comprises a granular bed material and a fluidizing medium. The black liquor is gasified by providing a heat input to the fluidized bed. The heat input can be provided by heat transfer surfaces such as heat exchanger tubes which are located in the bed material. U.S. Pat. No. 5,059,404 describes one such indirectly heated process using pulse combustion. Some methods require the addition of heat input directly to the bed material itself through the consumption of product being gasified.

A common problem associated with heat exchanger tubes located in the material bed is that the tubes are subjected to fouling and corrosion due to their proximity with the fluidizing bed material. A major problem associated with the direct heat input to the material bed is that potential high temperature spots created through the direct heat input sometimes result in the formation of smelt, i.e. molten inorganic constituents resulting from the reduction of black liquor in the bed material.

There is a need for an improved system and method for gasifying residual waste liquor that does not foul or corrode heat transfer surfaces and avoids smelt formation problems.

SUMMARY OF THE INVENTION

The present invention pertains to a system and method for heating a fluidized bed gasification of a residual waste liquor such as a black liquor in processes like the Kraft paper making process.

The system according to the present invention comprises a granular bed of material which receives a source of liquor for gasifying. The system also includes an injector positioned in the material bed which receives an air source, a fuel source and a steam source. Air and fuel are combusted within the injector for producing a combustion product which is mixed with steam and, in turn, injected into the material bed. The combustion product is formed within the injector and is separated from the fluidized bed prior to injection with the steam.

One embodiment of the injector comprises a bubble cap having at least one hole for injecting the steam and combustion product mixture into the material bed. A second embodiment comprises an injector made of a porous ceramic material in which the steam and combustion product mixture exits through the pores into the material bed.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
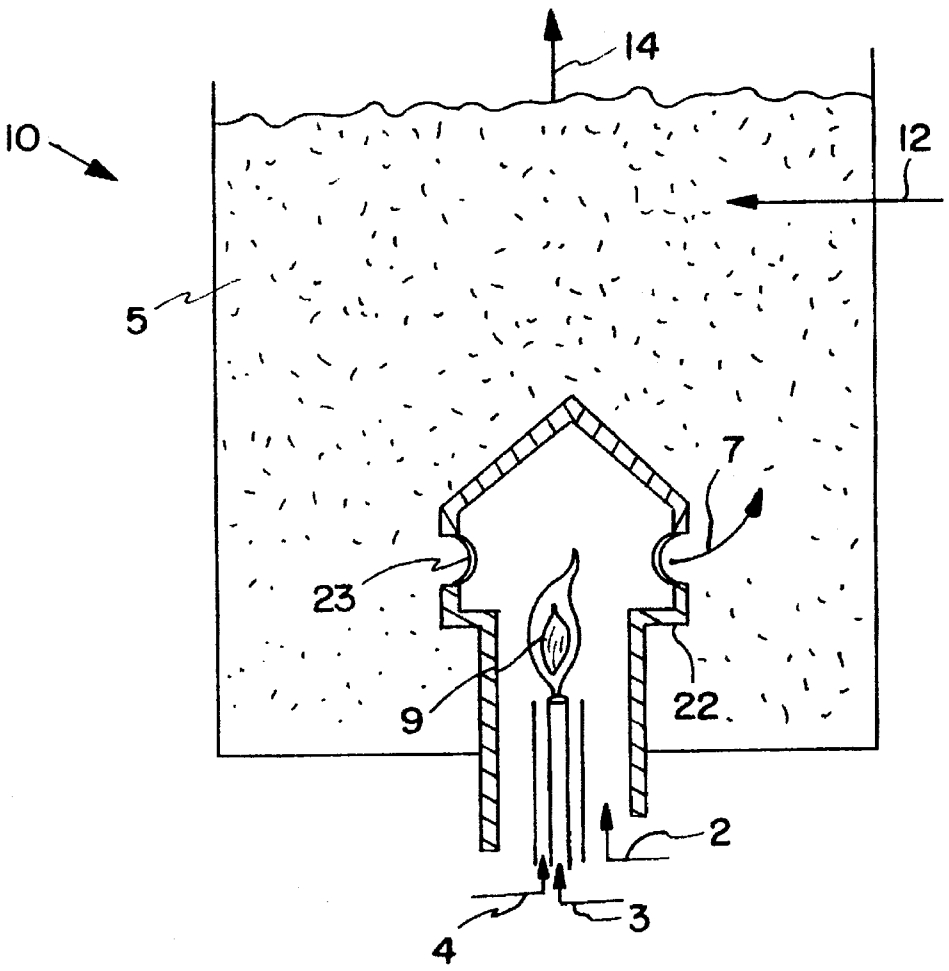
FIG. 1 is a schematic view of a first embodiment of the present invention.

The present invention provides a system and method of fluidized bed gasification of residual waste. The term residual waste is meant to include any solid or liquid carbonaceous or cellulosic waste. As illustrated in FIG. 1, the present invention comprises a black liquor gasifier, generally designated 10, having a fluid bed material 5 which is granular and includes alkali salts. Black liquor 12 is provided to or above the bed material 5 for being gasified.

The present invention also utilizes an injector such as a bubble cap injector 22 or a porous ceramic injector 20 (FIG. 2) for providing a fluidizing medium like a mixture of combustion products and steam to the bed material 5. Injector 22 is a bubble cap having at least one hole 23. The bubble cap 22 receives a stream of air 4 and fuel 3 which is combusted at flame 9. Steam 2 is provided to the bubble cap 22 and is heated by direct mixing with the combustion product produced at flame 9. In turn, a steam and combustion product mixture 7 produced by injector 22 is injected into the granular bed material 5 as a heated fluidizing medium for the gasifier 10.

Figure 2:
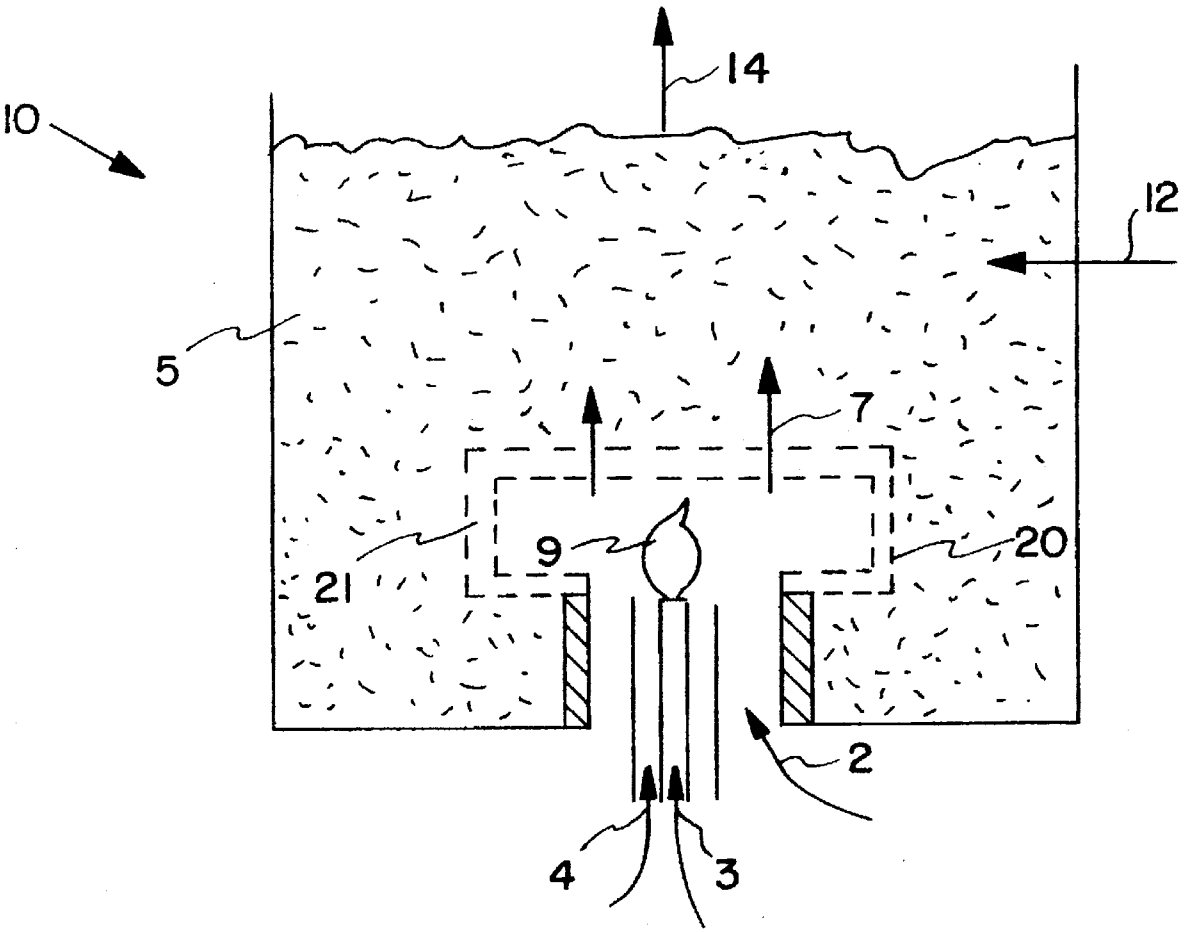
FIG. 2 is a schematic view of a second embodiment of the present invention.

For both the bubble cap injector 22 and the porous ceramic injector 20 (FIG. 2), the fuel gas 3 can be either a natural gas or cleaned gasifier product gas from the gasifier 10 which is mixed with the air 4 and burned at flame 9. The hot combustion products produced at flame 9 are mixed with a low pressure steam 2 which is either saturated or super heated within the injectors 22 and 20 (FIG. 2). While one injector 20, 22 is shown in the bed, one or more injectors can be employed at the bottom of the fluid bed.

FIG. 2 shows injector 20 as a porous ceramic injector having a plurality of pores 21 for injecting the steam and combustion product mixture 7 into the bed material 5. The steam and combustion product mixture 7, when mixed with the black liquor 12 in the fluidized bed material 5, produces a gasification product gas 14.

It is important to note, as shown in FIGS. 1 and 2, that the combustion of the fuel 3 and air 4 and mixture of the steam 2 is confined within the injectors 20 and 22 by being maintained separately from the fluid bed material within the injectors 20 and 22.

The present invention provides a temperature (T) which is a mixture temperature of the steam and combustion product mixture 7 which is less than the smelting temperature ($T_{sm}$) which is normally about 1400° F. of the gasifier 10. Within the injectors 20 and 22, the steam 2 is increased to a temperature ranging from 1100° F. to 1350° F. through mixing with the combustion products prior to injection into the bed material 5.

The gas and steam flow rates are controlled in order to insure that the mixture temperature T is less than the smelting temperature $T_{sm}$. Safety interlocks can be utilized to ensure sufficient steam flow in order to avoid temperature upsets. Moreover, the injectors 20 and 22 can be provided directly in the bed material 5.

The present invention provides for several advantages which are not found in any of the known systems and methods for gasifying black liquor. One advantage is that heat is input into the fluidized bed material 5 without the use of any heating surfaces. A second advantage is that the present invention allows for high temperature fluidizing medium for bed fluidization without contacting the medium with structural or support members. A third advantage is that the present invention alleviates the need to provide the combustion of product gas or natural gas directly in the bed material for extra heat input. A fourth advantage of the present invention is that the temperature of the gases is controlled in the fluidized bed material without resulting in the creation of smelt. A fifth advantage of the present invention is that the present invention eliminates the potential need for a high temperature steam superheater. A sixth advantage of the present invention is that through the use of steam as the primary fluidizing medium, dilution of product gas with nitrogen is minimized. A seventh advantage of the present invention is that the injectors are cooled by steam and the fluidized bed material.

While specific embodiments of the invention have been shown and described in detail to illustrate the application of the principles of the invention, it will be understood that the invention may be embodied otherwise without departing from such principles.

What is claimed is:

1. A method for gasifying a carbonaceous or cellulosic waste liquor, the method comprising the steps of:

providing a fluidized bed of material;

providing the carbonaceous or cellulosic waste liquor to the bed of material;

burning a fuel for producing a combustion product;

mixing the combustion product with steam for forming a steam and combustion product mixture; and injecting the steam and combustion product mixture into the bed of material in the interior of an injector located within the bed of the fluidized material for gasifying the waste liquor, the injector having at least one bubble cap having at least one hole.

2. The method according to claim 1, wherein the temperature of the steam and combustion mixture is less than a smelting of the liquor solids in the fluidized bed of material.

3. The method according to claim 1, wherein the temperature of the steam is increased to a temperature ranging from 1100° F. to 1350° F. prior to being injected into the fluidized bed of material.

4. A method for gasifying a carbonaceous or cellulosic waste liquor, the method comprising the steps of:

providing a fluidized bed of material;

providing the carbonaceous or cellulosic waste liquor to the bed of material;

burning a fuel for producing a combustion product;

mixing the combustion product with steam for forming a steam and combustion product mixture; and injecting the steam and combustion product mixture into the bed of material in the interior of an injector located within the bed of the fluidized material for gasifying the waste liquor, the injector being made of a porous ceramic material.

5. The method according to claim 4, wherein the temperature of the steam and combustion mixture is less than a smelting of the liquor solids in the fluidized bed of material.

6. The method according to claim 4, wherein the temperature of the steam is increased to a temperature ranging from 1100° F. to 1350° F. prior to being injected into the fluidized bed of material.

* * * * *